United States Patent [19]

Young et al.

[11] Patent Number: 5,016,311

[45] Date of Patent: May 21, 1991

[54] APPARATUS AND BRUSH SEGMENT ARRANGEMENT FOR FINISHING WHEEL BRUSHES; AND METHOD

[75] Inventors: John B. Young; Roger C. Lokken, both of Woodbury, Minn.

[73] Assignee: Minnesota Mining and Manufacturing Company, St. Paul, Minn.

[21] Appl. No.: 477,192

[22] Filed: Feb. 5, 1990

Related U.S. Application Data

[63] Continuation of Ser. No. 186,907, Apr. 27, 1988, abandoned.

[51] Int. Cl.[5] ..... A46B 13/02

[52] U.S. Cl. ..... 15/88.3; 15/179; 15/183; 15/217; 15/230.14; 15/230.16; 15/230.19; 29/120; 29/124; 51/364

[58] Field of Search ..... 15/186, 187, 188, 179–183, 15/154 A, 215–217, 238, 230.13; 51/364–366, 358, 334; 29/120, 127, 121.1; 101/415.1, 377

[56] References Cited

U.S. PATENT DOCUMENTS

| | | | |
|---|---|---|---|
| 2,125,460 | 8/1938 | Plengemeir | 51/194 |
| 2,303,386 | 12/1942 | Peterson | 300/21 |
| 2,316,185 | 4/1943 | Peterson | 15/181 |
| 2,415,308 | 2/1947 | Schulte | 51/191 |
| 2,430,099 | 11/1947 | Bradley | 51/194 |
| 2,639,560 | 5/1953 | Cosmos | 51/141 |
| 2,757,401 | 8/1956 | Peterson | 15/182 |
| 2,789,075 | 4/1957 | Stahl | 29/120 X |
| 2,845,648 | 8/1958 | Peterson | 15/159 |
| 2,871,632 | 2/1959 | Cosmos | 51/193.5 |
| 2,879,631 | 3/1959 | Peterson | 51/185 |
| 2,921,329 | 1/1960 | Peterson | 15/182 |
| 2,978,726 | 4/1961 | Park | 15/DIG. 5 |
| 3,043,063 | 7/1962 | Peterson | 51/193 |
| 3,072,470 | 1/1963 | Hinshaw | 51/293 |
| 3,072,945 | 1/1963 | Peterson | 15/202 |
| 3,076,219 | 2/1963 | Peterson | 15/179 |
| 3,105,988 | 10/1963 | Peterson | 15/179 |
| 3,122,766 | 3/1964 | Peterson | 15/179 |
| 3,128,487 | 4/1964 | Vallis | 15/187 X |
| 3,129,269 | 4/1964 | Charvat | 264/45 |
| 3,134,123 | 5/1964 | Nelson | 15/182 |
| 3,139,641 | 8/1964 | Grogan et al. | 15/182 |
| 3,147,503 | 9/1964 | Charvat | 15/179 |
| 3,186,019 | 6/1965 | Hattori | 15/179 |
| 3,439,551 | 4/1969 | Militana | 74/243 |
| 3,455,068 | 7/1969 | Belanger | 51/337 |
| 3,512,311 | 5/1970 | Block | 51/334 |

(List continued on next page.)

FOREIGN PATENT DOCUMENTS

| | | | |
|---|---|---|---|
| 085091 | 1/1954 | France . | |
| 1085091 | 7/1954 | France | 15/187 |
| 946422 | 1/1964 | United Kingdom . | |

OTHER PUBLICATIONS

FIG. 1–Crimp Channel Brushes.

FIG. 2–Multiple Crimp Channel Wheels.

(List continued on next page.)

*Primary Examiner*—Philip R. Coe

*Assistant Examiner*—Mark Spisich

*Attorney, Agent, or Firm*—Merchant, Gould, Smith, Edell, Welter & Schmidt

[57] ABSTRACT

A brush segment for mounting on a slotted support structure is presented. The brush segment generally comprises: a substrate; a carpet of bristles mounted on the substrate in a preferred manner; and, a root system projecting outwardly from a side of the substrate opposite from the carpet of bristles. Brush segments according to the present invention are particularly well-adapted for mounting in association with longitudinal slots of a cylindrical hub arrangement, including conventional cylindrical hub arrangements. According to a first described embodiment, the substrate is flat and relatively flexible, and includes a plurality of root members thereon, for mounting. In a second embodiment described, the substrate is generally curved, elastic and includes a single centrally located root member, for mounting. Also according to the present invention a combination of a hub and at least one brush segment is described. Further, a method of preparing a brush surface is also provided.

7 Claims, 3 Drawing Sheets

U.S. PATENT DOCUMENTS

| | | | |
|---|---|---|---|
| 3,527,001 | 9/1970 | Kleemeier et al. | 51/358 |
| 3,533,125 | 10/1970 | Bue chel et al. | 15/183 |
| 3,533,198 | 10/1970 | Burns | 51/337 |
| 3,535,833 | 8/1974 | Belanger | 51/337 |
| 3,621,622 | 11/1971 | Belanger | 51/337 |
| 3,626,646 | 12/1971 | Belanger | 51/337 |
| 3,645,049 | 2/1972 | Freerks et al. | 51/334 |
| 3,653,856 | 4/1972 | Field | 51/334 |
| 3,688,335 | 9/1972 | Clark | 15/182 |
| 3,699,727 | 10/1972 | McDonald | 51/334 |
| 3,747,285 | 7/1973 | Block | 51/358 |
| 3,755,847 | 9/1973 | Liebscher | 15/187 X |
| 3,798,847 | 3/1974 | Belanger | 51/337 |
| 3,800,481 | 4/1979 | Belanger | 51/337 |
| 3,842,547 | 10/1974 | Belanger | 51/334 |
| 3,846,942 | 11/1974 | Belanger | 51/334 |
| 3,862,462 | 1/1975 | Reiter | 15/182 |
| 3,862,463 | 1/1975 | Reiter | 15/182 |
| 3,869,833 | 3/1975 | Belanger | 51/334 |
| 3,875,607 | 4/1975 | Rosseau | 15/180 |
| 3,879,903 | 4/1975 | Belanger | 51/337 |
| 3,900,915 | 8/1975 | Rosseau | 15/182 |
| 4,037,369 | 7/1977 | Campbell | 51/400 |
| 4,055,028 | 10/1977 | Belanger | 51/334 |
| 4,055,919 | 11/1977 | Belanger | 51/334 |
| 4,071,920 | 2/1978 | Block | 15/49 |
| 4,080,714 | 3/1978 | Emerson | 29/509 |
| 4,112,040 | 9/1978 | Orentreich | 264/176 F |
| 4,133,147 | 1/1979 | Swift, Jr. | 51/400 |
| 4,204,292 | 5/1980 | Lester et al. | 15/28 |
| 4,239,002 | 12/1980 | Rosenstein | 101/377 |
| 4,267,616 | 5/1981 | Hunt | 15/182 |
| 4,285,171 | 8/1981 | Block et al. | 51/337 |
| 4,296,346 | 10/1981 | Ooki et al. | 310/242 |
| 4,305.234 | 12/1981 | Pichelman | 51/330 |
| 4,322,920 | 4/1982 | Wells | 51/168 |
| 4,369,606 | 1/1983 | Reiman | 51/334 |
| 4,490,872 | 1/1985 | Drumm | 15/182 |
| 4,490,877 | 1/1985 | Drumm | 15/182 |
| 4,493,172 | 1/1985 | Jones | 52/220 |
| 4,567,619 | 2/1986 | Clark | 15/97 B |
| 4,627,127 | 12/1986 | Dupre | 15/179 |
| 4,646,479 | 3/1987 | Walker et al. | 51/328 |

OTHER PUBLICATIONS

FIG. 3–Crimp Channel Strips in a Slotted Hub.

"Brushlon ® Products," 3M Company.

"Brushlon ® Brush Material," 3M Company.

"Introducing Brushlon ® . . . 'Roll Your Own' Brush Material," 3M Company.

"PPG Pittex ® Filament Power Driven Brushes," PPG Industries.

FIG. 4–3M Brushlon ® Brand Material, 3M Company.

FIG. 5–3M Brushlon ® Brand Material, 3M Company.

"A User's Guide to the Preparation, Cutting, and Wrapping of 3M Brushlon 'Roll Your Own' Material," 3M COmpany.

"Tynex ® 'A' Abrasive Filaments for Industrial Brushes," DuPont Company.

"PPG Power Driven Brushes for Surface Conditioning with Fiber Glass Plus!", PPG Industries.

"New Scotch-Brite ® Brand Brushes for High-Speed Cleaning and Finishing," 3M Company.

"The Print Room," 3M Company.

"Scotch-Brite ® Brand Cleaning Brush," 3M Company.

FIG. 6–Elongated Abrasive Bristles Mounted in a Metal Root.

Fig. 7–Elongated Abrasive Bristles Mounted in a Metal Root.

Fig. 8–Elongated Abrasive Bristles Mounted in a Metal Root.

FIG. 9–3M Long Trim Brush–Segments in a Slotted Hub.

"3M Coated Abrasives–Special FOrms and Maintenance Items," 3M Company.

"Type 81 Small PG ® Wheels," 3M Company.

"3M Brand Heavy Duty Roto Peen Descaling & Cleaning System for Metal," 3M Company.

FIG. 10–Finishing Apparatus with Abrasive Flaps.

FIG. 11–Various 3M Hubs, 3M Company.

FIG. 12–Non-woven Abrasive Material Between Abrasive Flaps in a Fabric Root.

FIG. 1
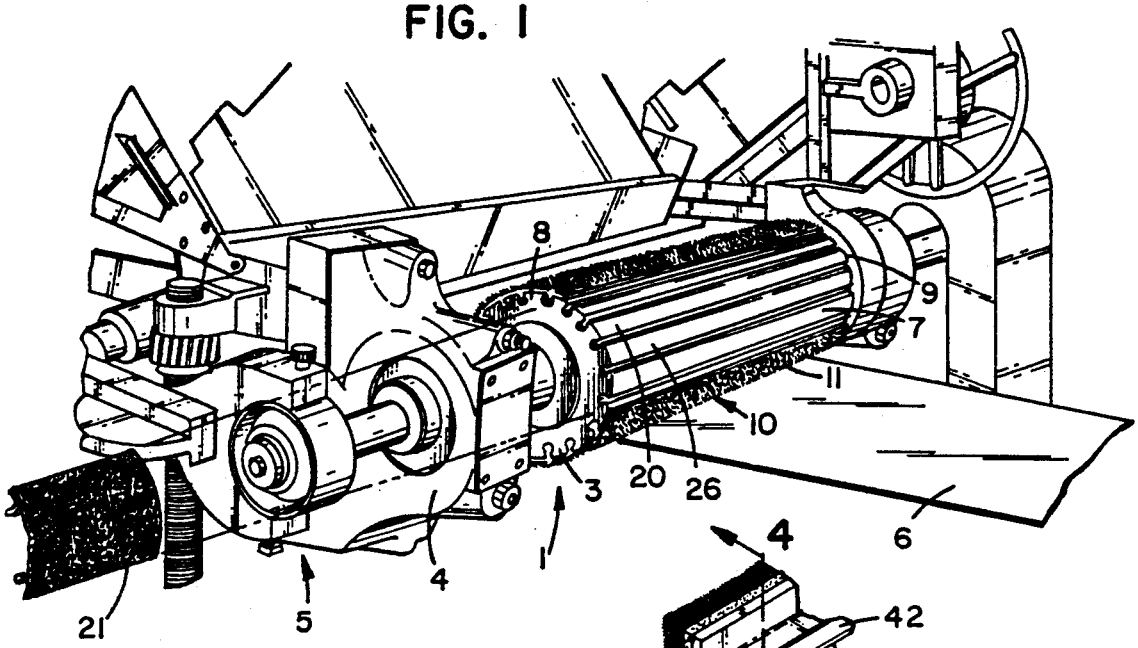
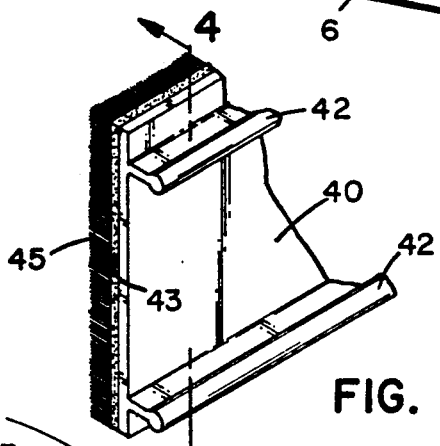
FIG. 3
FIG. 2
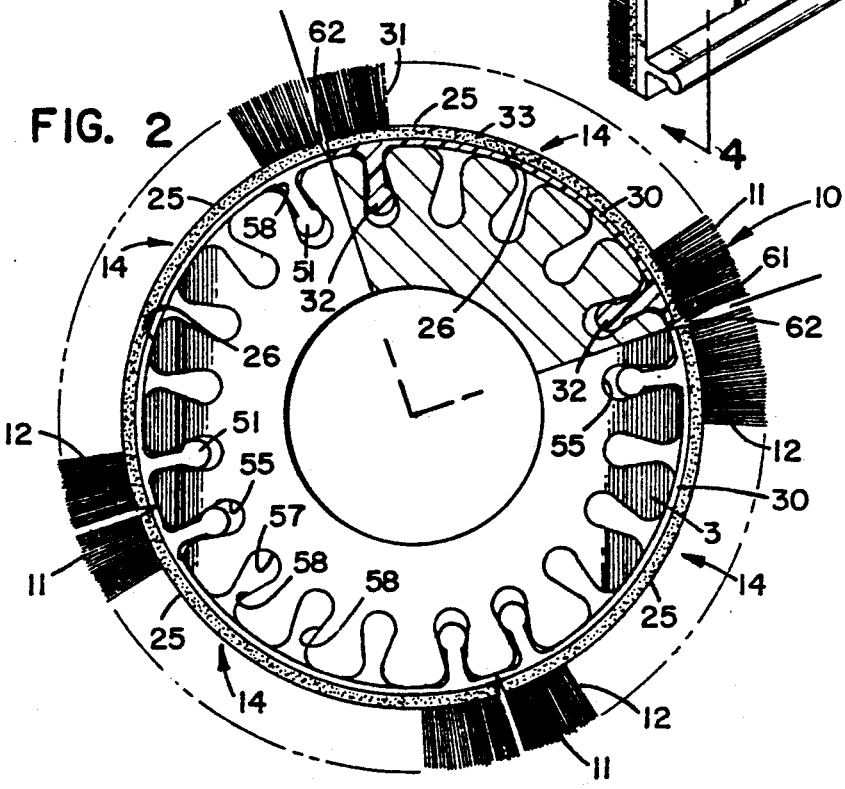

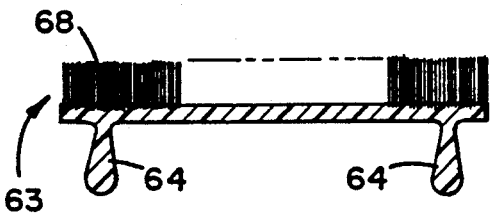
FIG. 11
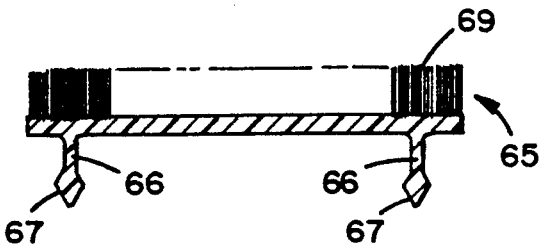
FIG. 12
FIG. 13
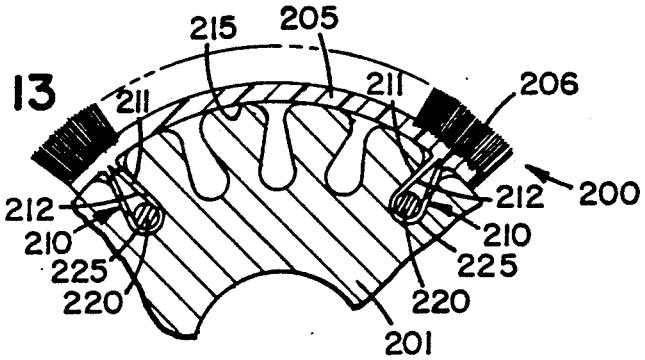
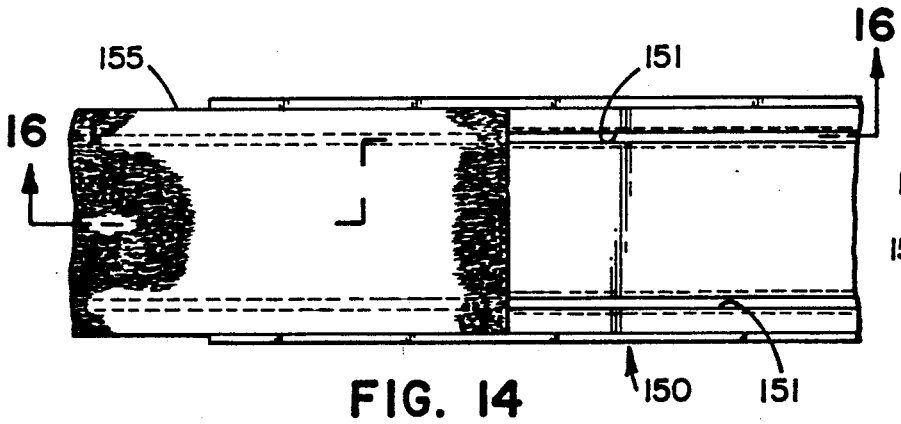
FIG. 14
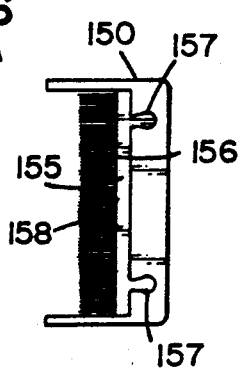
FIG. 15
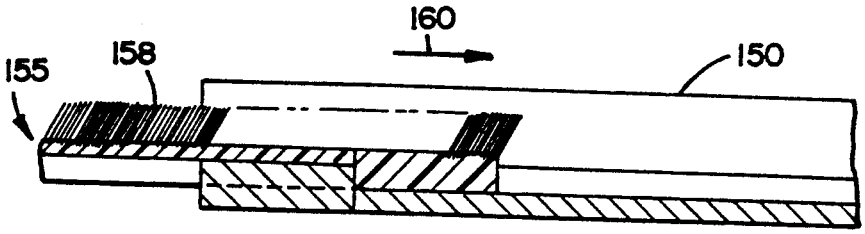
FIG. 16

APPARATUS AND BRUSH SEGMENT ARRANGEMENT FOR FINISHING WHEEL BRUSHES; AND METHOD

This is a continuation of application Ser. No. 07/186,907, filed Apr. 27, 1988, now abandoned.

FIELD OF THE INVENTION

The present invention concerns industrial brushes, and in particular arrangements for mounting such brushes in association with a carrier substrate. The preferred embodiment concerns finishing wheels having removable and replaceable brush segments thereon.

BACKGROUND OF THE INVENTION

In many industries, abrasive brushes are used to prepare and/or to finish materials. Brushes have been applied, for example, to: generate satin finishing of metal; deburr metal products; finish wood materials; conduct flash removal from plastics; facilitate oxide removal from metallic materials; and, to clean and/or etch glass. To accomplish these, and other applications, industrial brushes have been provided with a variety of types of bristles including bristles made from: polyesters, polyethylene, nylon and polypropylene strands or fibres. The bristle material may, optionally, be impregnated with abrasive materials. The various types of fibres have found use in a wide variety of applications, to obtain varying effects in surface treatment of articles brought into association with the brush.

For many industrial applications, the brushes are mounted on wheels or rollers which are rapidly spun during a finishing operation. In a typical industrial application, an elongate cylindrical roller having brush material mounted thereon is provided. Material to be treated is then passed along a conveyed path and into engagement with the brush media.

A major concern of the finishing products industry has been the development of convenient, effective, methods for the mounting of brush elements, i.e. fibrous or bristle material, onto industrial finishing rollers, wheels or the like. Other major concerns in the industry have involved the nature of the fibre or bristle mounting within the brush element.

As to brush bristle mounting, many industrial brushes are of one of three types: crimped channel construction; tufted construction; and, products in which individual bristles are mounted tightly packed but spaced independently and not in either tufts or crimped channels, i.e., the bristles form a carpet-like arrangement of individually mounted bristles.

Crimp channel brushes are generally made by securing the base end of the bristles in a metal channel. The channel is usually formed in such a manner that the bristles are held fast, when sides of the channel are forced together or crimped. In some constructions, the bristles are individual strands held in the channel. However, often the bristles are folded in half, and the bent loops are mounted in the channel.

Tufted brushes are very common in both industrial and consumer applications. Tufted brushes are characterized by an anchoring of a group of bristles (the tuft) in a hole or other receptacle in a base material. The tuft is then secured within the receptacle by: heat-bonding; an adhesive; stapling; stitching; or, by some other, similar, means. The size and shape of a tufted brush is defined generally by the design of the base or substrate to which the tufts are attached. The distribution of brush media is determined by the pattern of receptacles in the base, and the number of bristles in each tuft. Such media can be arranged to form a carpet-like bed of bristles.

The third general type of industrial brush comprises a construction wherein bristles are anchored individually, rather than in groups or bunches. Typically, the bristles are anchored in a flexible base that allows the brush media to conform to a variety of configurations. A particularly well-known example of this type of brush is the Brushlon® line of products (3M, St. Paul, Minn. 55144). Such brushes involve anchoring of bristles in a polymeric bed (resin) either applied to or including a substrate. Such systems form a thick carpet-like bed of bristles. In some applications, the bristles may be directly set in the substrate.

For many industrial applications, the third type of arrangement (individually mounted bristles) is preferred. Reasons include the fact that the construction generally avoids gaps between fibres, which could clog with collected particles. Further, individual bristles are less likely to break, due to good support provided by adjacent bristles or fibres. Also, since the fibres are spread relatively evenly across the work surface, each fibre or bristle, in a localized region, is more likely to be worked to approximately the same extent as other bristles. Thus, such arrangements wear relatively well.

A variety of methods have been utilized for the attachment of brush materials to substrates such as finishing wheels. For example, strips of crimp channel brush material have been constructed such that they can be mounted on a cylinder, for use in a grinding operation. Tufted brushes have frequently involved a permanent mounting of tufts, in a substrate device adapted for mounting as a wheel or the like, for a finishing operation. Individually set bristle products, such as Brushlon® products, have been provided on flexible backing, attachable by a variety of means, including hook and loop mounting means (such as Velcro®), to wheel cylinders etc. for use.

Products other than brushes have been utilized for surface finishing operations, on various materials. These include abrasive flap-wheel arrangements having flaps formed from extensions of fibrous non-woven abrasive material such as Scotchbrite® abrasive material (3M, St. Paul, Minn. 55144) and elongate sacrificial fibre products. Other finishing devices include grinding wheels, and coated abrasive products such as sandpaper or the like. For any of these three types of arrangements, generally the abrasive material is sacrificed during use, with a final discarding of an associated core or substrate. It is noted that abrasive flap wheels frequently involve rather elongate paddle-like flaps of material, which during rotation of a associated hub, are spun into association with a substrate to be treated.

It is desirable to provide abrasive finishing arrangements wherein the abrasive material can be relatively easily removed or replaced. For non-brush abrasive arrangements, this could generally be accommodated by having a mounting system whereby extensions or flaps of abrasive material can be easily removed and replaced. For brush arrangements, the nature of mounting and the ease with which replacement can be obtained has, generally, depended upon the nature or classification of brush involved.

Crimp channel brush media has been made available in spiral form, so that it can be mounted to a reuseable hub by wrapping the brush tightly around the hub and clamping down ends of the brush.

As previously indicated, arrangements utilizing individual bristles mounted spaced from one another to a flexible substrate have also been provided in removable, replaceable, forms. Most notably, for example, the 3M Brushlon ® product has been provided with a hook and loop mounting system in association therewith, for attachment to wheels or rollers also having hook and loop attachment means thereon. For example, in forming a roll or cylinder brush, an elongate strip of 3M Brushlon ® material might be wrapped spirally about the cylinder.

Non-woven abrasive products are also available in belt form, and have been mounted on expanding rubber wheels or the like. Also, hook and loop mounting systems have been utilized for such products, although generally they have involved mounting on flat surfaces rather than cylinders. Reusable hubs have been used with non-woven abrasive materials, by mounting a series of doughnut-shaped pieces onto a hub with clamping at ends.

One problem with mounting methods that have involved winding of brush material about a hub or the like, is that a considerable length of time, and care, may be needed in order to achieve effective, proper, placement and alignment of brush bristles. For example, in applying 3M Brushlon ® stripping to a roller, substantial down time to the roller device may be necessary while the spiral mounting is accomplished. In some instances, it may even be necessary to remove the roller from the brush equipment, in order to obtain replacement. Similar problems would prevail with many spirally mounted arrangements regardless of the type of brush media involved.

Another problem with spirally wound systems, is that ends of the narrow strands present problems, or weak points, for attachment. Thus, in some instances special anchoring may be necessary at the very ends of the narrow strips; for example, 3M Brushlon ® strips are generally anchored by bolts or the like, at opposite ends. These anchors can provide significant problems for several reasons: first, the anchors may generate a small bald spot in a brush. Secondly, setting of the anchors may require special tools or equipment. Further, the anchors may generate a weak spot, or flaw, in the brush substrate.

For some abrasive cylinder applications, slotted hubs have been developed. An example of such a slotted hub is the 3M RX hub. Slotted hubs will be described in further detail below, with respect to a detailed description of the invention. In general, slotted hubs comprise an elongate cylinder having a plurality of longitudinal slots around the outer surface of the cylinder. Each slot is sized and oriented for anchoring of material thereto. Although a variety of arrangements may be utilized, in general in accord with industry standards and general agreement, about five slots per inch outside diameter have been frequently used.

Crimped channel or strip brushes are sometimes mounted in slotted hubs. In general, the crimp or strip, having bristles extending therefrom, is slid, longitudinally, into one of the cylinder channels and is retained therein. Retention is frequently accomplished through use of a channel having a wide internal portion and a narrow neck; with the brush material being anchored in a relatively wide root of material. The brush material can be slid longitudinally into the slot, with radial separation from the hub being basically impossible due to interference, but with longitudinal separation being relatively simple to achieve.

The common type of finishing wheel arrangement using a slotted hub, is one wherein the replaceable segments comprise abrasive flap segments. Each group of abrasive flaps is generally mounted to a root, which is anchored to the slotted hub. Examples of these include products marketed by 3M under the designations RX and RXC. RX segments contain coated abrasive flaps and RXC segments contain non-woven Scotchbrite ® abrasive material, as well as coated abrasive flaps.

In many conventional applications of longitudinal slotted hubs, each abrasive member is mounted on a single root. The abrasive members are such that each abrasive member/root combination is capable of a certain amount of hinged movement, or pivoting movement, (i.e. flapping) with respect to the hub itself.

What has been needed has been a method and arrangement whereby a brush arrangement comprising a carpet-like arrangement of bristles, i.e. tufted or preferably individually anchored bristle arrangements, can be securely mounted in a slotted arrangement, for use as a cylindrical brush or the like. What has been particularly needed has been an arrangement whereby mounting, removal and replacement of brush material may be rather readily effected.

SUMMARY OF THE INVENTION

According to the present invention a brush segment for mounting on a slotted support structure is provided. The slotted support structure may be of a variety of types including: cylindrical hub arrangements, such as the conventional cylindrical hub arrangement available from 3M as an RX hub; and, flat, slotted, support structures provided in a vibrating table arrangement or the like. In general, the brush segments comprise: a substrate having first and second opposite surfaces; a carpet of bristles mounted on the substrate to extend outwardly from the substrate first surface; and, a root system extending outwardly from the substrate second surface, the root system being constructed and arranged to mount the substrate to the slotted support structure by engagement with at least one slot thereof. Means are provided in the brush segment to inhibit flapping or rocking movement even with a curved, conventional, hub such as an RX cylindrical hub. That is, each brush segment includes means thereon which ensures that the segment, when mounted on a slotted support, including even a conventional cylindrical support, will not rock, flap, tip or wobble substantially, relative to the support. This securing means is described in further detail below.

Preferably, the carpet of bristles comprises a plurality of spaced, independently-mounted bristles. Herein the terms "carpet", "carpet-like" or variants thereof are meant to refer to an arrangement of bristles having an outer surface with substantial extension in two directions. That is, a "carpet" of bristles is more than a mere row of tufts or individually mounted bristles. Rather, the surface of the carpet exhibits substantial extension not only in length, but also width. A carpet of bristles may be formed, for example, from a plurality of substantially parallel rows of bristles or tufts of bristles, or it may be formed from randomly mounted bristles on a surface.

In one preferred embodiment, the substrate comprises a flat, elastic, rectangularly cross-sectioned, extension of material; and, the root system comprises a plurality of spaced, elongate, substantially parallel root members, each having a relatively broad head portion and a relatively narrow neck portion. Preferably, the root system is unitary, or integral, with the substrate. For the preferred embodiment shown, preferably the plurality of root members comprise two root members spaced from one another and oriented to extend along, adjacent, and spaced from, opposite side edges of the substrate.

In an alternate embodiment, preferably the substrate is a relatively rigid, but elastic, member having a convex side and a concave side, with the bristles extending outwardly from the convex side; and, with the root system extending generally outwardly from the concave side; the curvature of the concave side being generally perpendicular to an extension of the root system. Such an arrangement is particularly well-adapted for mounting in association with a cylindrical hub. Preferably, the concave side of the substrate has a first radius of curvature and the outer surface of the cylindrical hub has a second radius of curvature; the second radius of curvature being slightly larger than the first radius of curvature. As a result, the substrate will be snugly held against the cylindrical hub outer surface, when it is mounted thereon. For such an embodiment, preferably the root system comprises a single elongate root member, mounted on, or extending (projecting) outwardly from, the concave side of the substrate.

In preferred embodiments described and shown, each root member comprises a relatively rigid extension. In an alternate embodiment, each root member comprises an elongate sleeve expandable upon insertion of a rod member or expansion member therein.

Also, according to the invention a combination comprising a cylindrical hub and at least one brush segment is provided. The brush segment may be as previously described. In general, the cylindrical hub has an outer surface with a plurality of spaced, longitudinal, slots therein. Each slot generally includes a wide recessed or head-receiving area, and, also, a relatively narrow neck portion which extends between the recessed volume and an outer surface of the hub. The slots are oriented to receive therein, longitudinally, portions of a brush segment or plurality of brush segments as previously described. In such a combination, the cylindrical hub may be a conventional cylindrical hub such as a 3M RX hub.

Also according to the present invention when a plurality of brush segments are utilized to form a carpet of bristles around the outside of a cylindrical hub, a variety of advantageous arrangements may be provided. For example, segments, at least two of which have bristles of different construction, i.e. abrasiveness, length, strength, density, or direction of extension, may be used. Further, gaps in the outer brush surface can be selectively provided.

Also according to the present invention a method is described, for providing a brush surface on a cylindrical hub. Generally, the method comprises providing a cylindrical hub as previously described, and providing at least one brush segment as previously described. The brush segment is mounted on the cylindrical hub, according to the invention, by longitudinal insertion of a root system of the segment into a longitudinal slot formation of the hub.

In alternate embodiments the substrate comprises an elongate relatively flat vibrating table with slots therein. Brush segments according to the present invention can be mounted in such an arrangement, for use in treating the surface and materials passing along the vibrating table.

The drawings constitute a part of this specification and include exemplary embodiments of the present invention. It will be understood that in some instances relative material thicknesses and component sizes may be shown exaggerated, to facilitate an understanding of the invention.

BRIEF DESCRIPTION OF THE DRAWINGS

FIG. 1 is a fragmentary environmental perspective view of a slotted hub cylinder/brush arrangement combination according to the present invention.

FIG. 2 is an enlarged end elevational view of a slotted hub cylinder/brush arrangement combination according to the present invention, with a portion of the arrangement shown in cross-section.

FIG. 3 is an enlarged, fragmentary, bottom perspective view of a brush/substrate arrangement according to the present invention.

FIG. 11 is a cross-sectional view generally analogous to FIG. 4, but showing an alternate embodiment of a brush/substrate according to the present invention.

FIG. 12 is a cross-sectional view generally analogous to FIGS. 4 and 11, but showing an alternate embodiment of a brush/substrate arrangement according to the present invention.

FIG. 13 is a fragmentary end elevational view of a cylinder/brush arrangement combination according to the present invention; FIG. 13 illustrating an alternate embodiment of a brush/substrate arrangement according to the present invention.

FIG. 14 is a partially exploded, fragmentary, top plan view of a vibrating table having a brush/substrate arrangement according to the present invention in association therewith.

FIG. 15 is an end elevational view of the arrangement shown in FIG. 14.

FIG. 16 is a fragmentary cross-section of view taken generally along line 16—16, FIG. 14.

DETAILED DESCRIPTION OF THE PRESENT INVENTION

Figure 4:
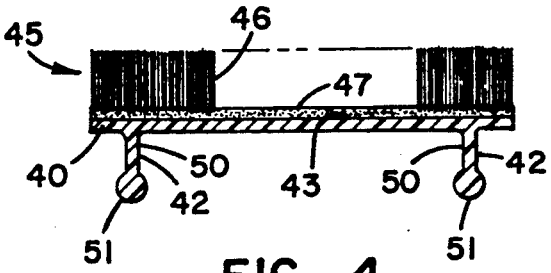
FIG. 4 is a cross-sectional view of a segment of brush-/substrate according to the present invention, usable for engagement with a conventional slotted hub or the like, FIG. 4 being taken generally along line 4—4, FIG. 3.

As required, detailed embodiments of the present invention are disclosed herein: however, it is to be understood that the disclosed embodiments are merely exemplary of the invention which may be embodied in various forms. Therefore, specific structural and functional details disclosed herein are not to be interpreted as limiting, but rather as a basis for the claims, and as a representative basis for teaching one skilled in the art to variously employ the present invention in virtually any appropriately detailed structure, system or manner.

The reference numeral 1, FIG. 1, generally illustrates an industrial cylinder brush finishing device modified according to the present invention. From the following descriptions, it will be understood that device 1 is generally conventional, except for the manner and arrangement by which brush material is applied to the cylinder hub. Specifically, device 1 comprises a horizontally mounted cylinder hub 3, mounted in a mechanical device 4 such that the hub 3 may be selectively rotated at a preferred speed. Arrangement 4 generally not only includes a drive mechanism 5 for hub 3, but also adjustment means (not detailed) for selective positioning of the hub 3, relative to a track or path of movement of articles, such as article 6, to be treated upon passage through the arrangement 4.

The cylindrical hub 3 depicted generally comprises a conventional hub, such as a 3M RX hub. The hub core may, for example, be: constructed from a single piece of extruded aluminum; or cast relatively from hard plastic, including casting from thermal plastic resins and casting from thermal setting resins. It may also be machined from steel or constructed from similarly rigid material. The hub 3 comprises an elongate cylinder member 7 having longitudinal slots therein. For the embodiment shown, there are about five slots for every inch outside diameter of the hub. For typical hubs, the longitudinal slots extend the complete length of hub 3, and thus each slot opens to opposite ends 8 and 9 of the hub 3. An end view of hub 3 is presented in FIG. 2, with a portion shown in cross-section.

Hub 3, FIGS. 1 and 2, forms part of a cylinder brush 10 which, FIG. 2, has a brush surface 11 formed from a plurality of bristles 12 mounted in a substrate arrangements 14. For the embodiment shown, bristles 12 are mounted independently, and spaced from one another, in substrate arrangement 14. That is, the bristles 12 form a Brushlon ®-type carpet of bristles. An advantage to this, is that brush surface 11 comprises a dense, somewhat evenly spaced, carpet of bristles 12. Spaces between clumps, tufts or rows, of bristles are avoided to advantage.

It is noted that a cylinder brush having a carpet of bristles has been obtained in the past, by utilizing, for example, a 3M Brushlon ® arrangement. Specifically, a flexible strip of Brushlon ® material has been helically wound about, and attached to, a hub. However, such an arrangement has generally involved a smooth hub, rather than a slotted hub, and a hook and loop attachment mechanism operating between the bristle substrate combination and the hub itself. As previously explained, some problems with such conventional arrangements have concerned difficulties in mounting the helically wound substrate quickly, efficiently, and sufficiently accurately, in a preferred manner. Also, dismounting for service or change of bristle has been relatively slow. Further, selected, custom, bristle patterns are relatively hard to effect with such a system.

Referring to FIG. 1, a section 20 of hub 3 is shown not having brush material mounted thereon. A segment 21 of brush material suitable for mounting in section 20 is also depicted (fragmentary) in FIG. 1. The segment 21, having a design according to the present invention, is such that it can be readily mounted in section 20, and can be relatively easily removed therefrom for replacement, as selected.

The present invention generally comprises an arrangement and manner whereby brush surfaces such as surface 11 can be relatively easily mounted on a conventional roller hub, having longitudinal slots therein. The result is an arrangement having a thick outer brush surface comprising a carpet of bristles, and the advantages associated therewith. Advantages over the conventional helically wound Brushlon ® method at least in part result from the fact that the segments are more easily mounted and dismounted. Other advantages will be apparent from further descriptions.

Referring to FIG. 2, brush surface 11 is shown formed from a plurality of individual substrate segments 25 each having bristles 12 thereon. In particular, for the arrangement shown in FIG. 2, the outer brush surface 11 is shown formed from four segments 25, each of which extends through a 90° arc of the cylinder outer surface 26. Thus, for the arrangement shown in FIGS. 1 and 2, the outer brush surface 11 is formed from four elongate rows of segments corresponding to segment 21.

Each brush segment 25 includes: a substrate portion 30; a bristle portion 31; and, a root arrangement 32. Preferably, the substrate portion 30 is a polymeric plastic substrate which exhibits some elasticity and which can be readily flexed into the arcuate manner shown. That is, preferably substrate 30 is relatively flexible. Certain advantages from this flexible nature of substrate portion 30 will be apparent from the following.

The bristle portion 31 includes bristles which may be formed from a variety of materials including: metallic wires; plastic coated wires; and, plastic filaments. Examples of metallic wires are: steel wires; beryllium copper wires; stainless steel wire; "Z" nickel wire; copper wire; brass wire; bronze wire; and, aluminum alloy wire. For plastic coated wires, the plastic coatings may include: nylon; vinyl plastics; trifluorochloroethylene polymer, neoprene and copolymers of butadiene and acrylonitrile. Examples of plastic filaments include nylon, polypropylene, polyethylene, and polyester materials. The bristle material may optionally have abrasive particles impregnated into the bristles. The preferred bristle material comprises plastic filaments with or without abrasive particles.

Means are generally provided for attachment of the bristles 12 to the substrate portion 30. For the embodiment shown in FIG. 2, this means comprises a layer of polymeric resin material 33. It will be understood, however, that in some arrangements the attachment means may comprise part of the substrate portion 30 itself. That is, the bristles 12 could be imbedded directly into the substrate portion 30.

The root arrangement 32 may be integral (unitary) with the substrate portion 30, or it may be attached thereto by a variety of means. For the embodiment shown, the root arrangement 32 comprises extensions formed integrally (unitary) with the substrate portion 30.

One of segments 25 is depicted in FIGS. 1, 3 and 4. The segment 25 comprises an elongate flat rectangular substrate portion 40 having a pair of spaced elongate longitudinal roots 42 extending longitudinally therealong. On a side 43 of substrate 40 opposite roots 42, a bristle portion 45 comprising a bed or carpet of bristles 46 embedded in a resin system 47 is provided. The bristles 46 are individually retained (similarly to a 3M Brushlon® product). That is, for the embodiment shown in FIGS. 1 and 3, they are not formed in tufts and they are not formed in crimped channels or rows. The bed of bristles 46 is substantially continuous.

Preferably the substrate 40 is formed from a flexible polymeric material, such as a polyamide, polyether or acrylonitrile/butadiene/styrene copolymer. A variety of resins may be utilized to hold the bristles 46 in position. Preferably the resin system 47 is such as will be flexible, along with substrate 43. As previously indicated a variety of constructions of individual bristles and bristle materials may be utilized, the arrangement shown in FIGS. 1, 3 and 4 merely providing an example.

Roots 42 each include a narrow neck 50 and a relatively wide head 51. Referring to FIG. 2, the wide heads 51 are sufficiently sized so as to be capable of secure retention within the longitudinal channels 55 of hub 3. More specifically, FIG. 2, each channel 55 includes a relatively wide, deep, portion 57 and a relatively narrow neck portion 58. If roots 50 are slid longitudinally into the slots, the wide head portions 51 of the roots 42 will be radially secured or anchored within wide channel portions 57, due to interference with the narrow neck portions 58. Referring to FIG. 1, mounting of a segment 25 or 21 will be understood as occurring by longitudinal engagement with slotted hub 3, in the manner illustrated. Utilization of a somewhat flexible substrate 40 and resin system 47, permits curving or bending of the segment 25 (or 21) to accommodate curvature of the hub 3.

Referring to FIG. 4, for the embodiment shown each substrate 40 may include a plurality of roots, for the specific embodiment shown two roots, 42 thereon. The two roots 42 shown are spaced apart for receipt in the first and fifth of a set of five longitudinal slots, FIG. 2. It will be understood that advantages from using a flexible, elastic, flat substrate 40 result. First, along edges 61 and 62, of adjacent substrates 30, tight, snug, engagement with hub 3 will result. Further, a relatively small gap between adjacent bristles will occur.

Still referring to FIG. 2, it will be understood that for an arrangement in which the bristles 12 extend outwardly generally perpendicularly from the substrate 30 (perpendicular to a tangent for a curved substrate) along edges 61 and 62 a gap of substantial size between adjacent substrates will be magnified or increased, as the outer ends of the bristles are approached. In general, in order to maintain a substantially continuous brushing surface 11, it is desirable to maintain the gap between adjacent side edges 61 and 62 of substrates 30 to a relative minimum. In general, to achieve a substantially continuous brushing surface 11, a distance between brush segments of less than about 1.5 cm, and preferably less than about 0.75 cm is preferred. In some applications, maintenance of a relatively small gap between adjacent bristles can be facilitated through utilization of bristles along side edges 61 and 62 which are not substantially perpendicular with respect to the substrate 30.

A variety of root systems may be developed, including ones having specific shapes different from those shown. In addition, variations in the shapes of slots for hub arrangements may be utilized, for engagement by root systems according to the invention. What is generally required, is a combination of a longitudinal slot and a root design such as to provide for the function of secure anchoring or engagement.

Several alternate root designs are shown in the alternate embodiments illustrated in FIGS. 11 and 12. Referring to FIG. 11, the segment 63 shown includes teardrop-shaped root member 64. For the alternate embodiment of FIG. 12, the brush segment 65 includes a root member 66 having a diamond-shaped head portion 67. It is noted that for the embodiments of FIGS. 11 and 12, the brush bristles 68 and 69 respectively are shown mounted by direct embedding into the substrate, i.e. with no resin layer therebetween.

For the embodiment of FIGS. 1–4, the substrate has been described as flat, flexible and elastic, as shown in FIGS. 3 and 4, and as applied in FIGS. 1 and 2. The arrangements have been described as having a root system comprising first and second spaced roots, generally adjacent, but spaced inwardly from, opposite side edges 61 and 62 of the segment 25. Further, the individual roots 42 have been described and shown as being substantially continuous, and extending along the complete length of the associated segment 25, FIG. 3.

It will be understood that a variety of alternate arrangements may be provided. For example, not only may different shaped roots be used, but also: roots which do not extend continuously along the complete length of the substrate may be used; a number other than two roots may be utilized; the roots may be spaced differently than shown for the preferred embodiment; the roots may be reinforced by embedded structural material such as metal pieces, composite material, or the like; and, the roots need not be formed integral, or unitary, with the substrate 30. However, the arrangement depicted is advantageous, for convenience.

It is noted that for the embodiments shown or described in FIGS. 1, 2, 3, 4, 11 and 12, i.e. multi-root arrangements, means are automatically provided to inhibit any rocking, tipping or flapping of the substrate relative to the circular, cylindrical, hub. That is, secure mounting is ensured. This means comprises the two, spaced, roots which ensure anchoring without rocking. More specifically, anchoring at least two positions, in connection with a rigid, elastic, substrate ensures tight, non-rocking mounting.

Figure 5:
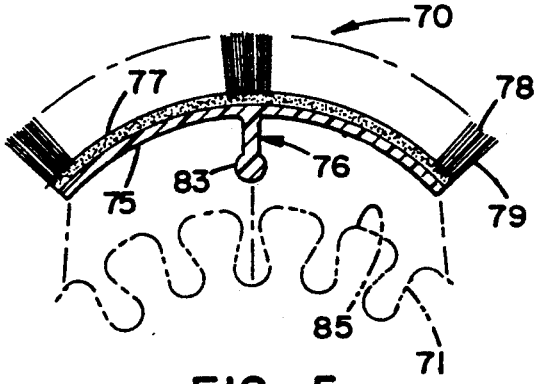
FIG. 5 is a fragmentary exploded view showing a brush/substrate arrangement according to an alternate embodiment of the present invention, in cooperation with a hub shown in phantom lines.

A particularly advantageous, alternate, embodiment is illustrated in FIG. 5. In FIG. 5 a segment 70 according to the alternate embodiment is depicted in cross-section; and, it is illustrated in exploded view with respect to a hub 71, analogous to hub 3, shown in phantom lines. Segment 70 includes: a substrate 75; a root arrangement 76; a resin system 77; and, a bed 78 of bristles 79. The bed 78 of bristles 79, and resin system 77, may be substantially analogous to those previously described, for the embodiment illustrated in FIGS. 1–4. In the alternative, the bristles 79 could be mounted directly in the substrate 75.

Two unique characteristics generally distinguish the embodiment of FIG. 5 from the embodiments of FIGS. 1–4 and 11 and 12. These concern: the shape of substrate 75; and, the nature of root system 76. More specifically, substrate 75 has a curved configuration, i.e. is a curved extension, rather than a flat configuration like the embodiment of FIGS. 1–4. Root arrangement 76 comprises a single, centrally located, root member 83.

For some applications, advantages can be obtained from the arrangement of FIG. 5. A substrate 75 having a single root member 83, for example, will typically encounter less friction in the longitudinal channel, during mounting, than will a substrate having two elongate root members thereon.

It will be apparent that with a single centrally located root member 83, a curved substrate 75 is necessary, in order to provide conformation of the substrate 75 to the curved outer surface 85 of the cylindrical hub 71. Preferably, and as illustrated in FIG. 5, substrate 75 is formed from a relatively rigid, but somewhat elastic, plastic or polymeric material having a concave side with a radius of curvature slightly smaller than the radius of curvature of the outer surface 85 of the hub 71. As shown in FIG. 5, when engagement between the segment 70 and hub 71 occurs, under such circumstances, relatively rigid substrate 75 will be forced to flatten out or spread out somewhat; and, due to its rigid, elastic, character, it will tightly press against the hub 71. This will provide a relatively snug engagement between the substrate 75 and the hub 71, and inhibit any tipping, flapping or rocking propensity that might otherwise occur for a segment 70 on a single, central, root member 83. Thus, an anti-flap arrangement or means is provided in the segment of the embodiment of FIG. 5, through use of a curved substrate, with a radius of curvature less than the support, in combination with a rigid, elastic, substrate material. This also helps ensure close association between adjacent segments 70 on a hub 71.

The above described brush segment arrangements offer unique advantages over prior brush designs. First, and as illustrated in FIG. 1, segments can be easily mounted, removed and replaced, as necessary. It will be understood, by examination of FIG. 1, that mounting and dismounting can generally be accomplished without removal of the hub 3 from the finishing apparatus 1. Unlike with a helically wound system, changing is relatively rapid and proper alignment between adjacent segments is relatively easily effected.

In application, mounting arrangements according to the present invention provide for a variety of possible arrangements. For example, FIG. 3, the brush surface 11 shown generally comprises four elongate strips or segments which extend completely longitudinally across the hub 3. It will be understood that there is, of course, no requirement that all four segments of brush material be identical. That is, different brush bristle constructions, density etc. can be used, for the different strips.

Figure 6:
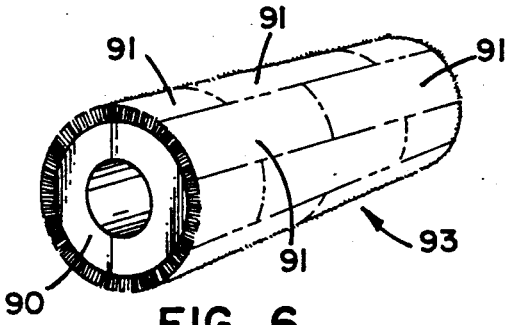
FIG. 6 is a schematic perspective view of a cylinder/-brush arrangement combination illustrating an application of the present invention.

Some useful variations in loading onto hubs are illustrated in FIGS. 6, 7, 8 and 9. In FIG. 6, for example, a hub 90 is shown having a plurality of sections or segments 91 of brush material mounted thereon. The individual sections or segments 91 do not extend completely longitudinally across hub 90. Thus, the overall cylinder brush 93 may be provided with a varying lateral construction. That is, different brush materials can be used in a row across the hub. The arrangement shown in FIG. 6 is "bricked"; that is, segment ends of adjacent rows do not align directly with one another, but rather they are offset. This arrangement would generally avoid the presence of small gaps between longitudinally adjacent brush segments extending completely around cylinder brush 93, at any given location.

Figure 7:
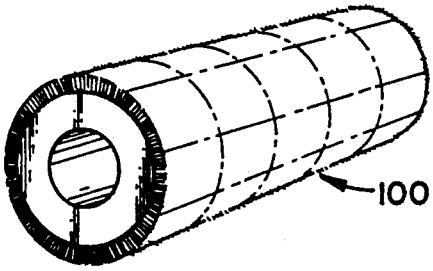
FIG. 7 is a schematic perspective view generally analogous to that shown in FIG. 6, but illustrating a different arrangement of brush/substrate segments.

The arrangement shown in FIG. 7 also illustrates that a plurality of segments may be utilized to provide an overall cylinder brush 100. Different bristle constructions including: variations in bristle lengths; variations in bristle abrasiveness; and, variations in bristle density, can be utilized in different segments, to advantage. For example, different surface effects on material being treated, or different effects in different areas of those materials being treated, can be obtained.

Figure 8:
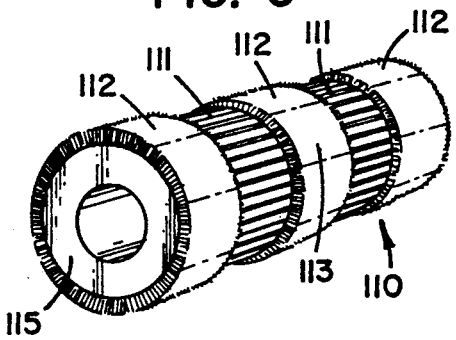
FIG. 8 is schematic perspective view generally analogous to that of FIGS. 6 and 7, but showing yet another alternate arrangement of brush/substrate segments according to the present invention.

In FIG. 8 an arrangement 110 is illustrated which shows that gaps 111 can be left between sections 112 of brush segments. Thus, for example, the surface of an article can be treated at only selected places, through selected location of such gaps 111.

It will be understood that in some applications, it may be desired to provide anchors or the like mountable in association with the longitudinal channels, to facilitate construction of an arrangement such as that shown in FIG. 8. The anchors can be used as stays, along ends of various individual segments 113, to prevent unintended longitudinal sliding of the segments 113 with respect to the hub 115. Further, for any of the embodiments, the hub 115 can be provided with stays or flanges on opposite ends, to prevent unintended longitudinal movement of segments mounted therein. No detail is provided with respect to anchors or stays in the longitudinal channels, or in association with the hubs, since any of a variety of arrangements could be utilized, and no specific arrangement is intended to be noted. Generally what would be operable would be an arrangement capable of being secured to the hub in a manner avoiding interference with brush activity, but which aligns with ends of brush segments inhibiting longitudinal sliding thereof.

Figure 9:
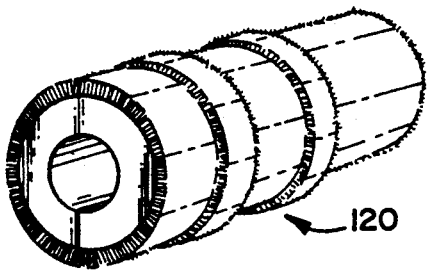
FIG. 9 is a schematic perspective view generally analogous to FIGS. 6, 7 and 8, but showing yet another alternate application of the principles of the present invention.

The arrangement 120 illustrated in FIG. 9 demonstrates that arrangements can be developed in which bristle sizes of various lengths can be provided in different portions of the arrangement. Such an arrangement could be used, for example, to treat a surface having troughs therein. An advantage to the present invention is that such custom arrangements can be easily and quickly provided, without substantial expense.

From FIGS. 6, 7, 8 and 9 it will understood that a wide variety of arrangements may be easily and readily provided through utilization of brush segments according to the present invention. Thus, through provision of a plurality of sets of brush segments, an operator of a finishing operation can readily change or modify existing cylindrical hubs, to accommodate a very wide variety of possible finishing operations. The examples illustrated in FIGS. 1, 6, 7, 8 and 9 are intended to be merely representational of possibilities, and not limiting.

Figure 10:
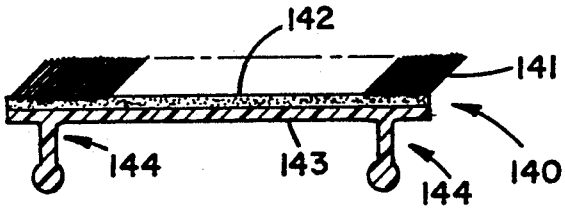
FIG. 10 is a cross-sectional view generally analogous to FIG. 3, but showing an alternate embodiment of a brush/substrate arrangement according to the present invention.

Another unique embodiment is illustrated in FIG. 10. FIG. 10 generally depicts a cross-sectional view analogous to that of FIG. 4, but of an arrangement 140 having bristles 141 extending outwardly at an angle, rather than perpendicular to the substrate. The arrangement 140 otherwise includes: a resin system 142; a flat, flexible, elastic substrate 143; and, a root arrangement 144.

It will be understood from reference to FIG. 10, that the arrangement 140 therein depicted can be mounted in the hub of a system such as that shown in FIG. 1 with the bristles 141 pointed generally toward the direction of rotation, or opposite to the direction of rotation. This can be utilized to achieve different finishing effects. Further, the very same arrangement 140 can be reversed after some use, to accomplish a different finishing effect. Therefore, an intent with respect to FIG. 10, is to depict that brush segments according to the present invention can be reversed after a period of use, if desired, for example to even wearing or achieve different finishing effects. Reversing would be possible for any of the embodiments shown; however unique advantages are obtained with an arrangement (FIG. 10) that is asymmetric with respect to reversal.

Another purpose of the arrangement shown in FIG. 10, is to suggest use in arrangements other than circular, cylindrical hub, arrangements. In conventional arrangements, angularly directed bristles 141 have been utilized with a flat, vibrating, surfaces. Articles to be treated are set on the vibrating surface and, as a result of the vibration, generally move in the direction toward which the bristles extend. During movement along the vibrating surface of the bristles, the effect of the bristles is to provide surface finishing of the articles. That is, the articles move on more or less stationary, but vibrating, brush segments. It will be understood that segments according to the present invention may be mounted in association with vibrating systems, if the vibrating systems are provided with appropriate mounting slots. Thus, for example, an industrial finishing operation which uses equipment with circular hubs and also equipment with flat, vibrating, finishing systems, may be able to utilize the same brush segments for both operations, if segments analogous to those illustrated in FIG. 2 are made; and, if both the hub equipment and the vibrating table equipment are appropriately adapted for mounting of the root system.

With respect to vibrating tables, attention is directed to the embodiments of FIGS. 14, 15 and 16. In FIG. 14 a top plan view of a vibrating table arrangement 150 is shown. The vibrating table includes a pair of elongate longitudinal slots 151 extending therealong. An extension of segment 155 is shown partially mounted in the longitudinal slots 151. It is noted that transverse slots, rather than longitudinal slots, may be used to advantage in some arrangements.

In FIG. 15 an end elevational arrangement is shown in FIG. 14 as depicted. The table 150 is shown with segment 155 partially mounted therein. Segment 155 is depicted including a substrate 156 a root arrangement 157 and bristles 158.

Referring to FIG. 16, segment 155 is shown in cross-section and bristles 158 are shown leaning in the general direction indicated by arrow 160. It will be understood as arrangement 150 is vibrated, articles resting on bristles 158 will generally move in the direction of arrow 160.

Referring to FIG. 13, an alternate root system is depicted. In particular, in FIG. 13 a brush segment 200 is shown mounted upon a hub 201. The brush segment 200 includes a substrate 205 having bristles 206 thereon. Segment 200 also includes a root arrangement 210, comprising a pair of root members 211. Each root member 211 includes an elongate sleeve 212 that is attached to, and depends from, a bottom side 215 of substrate 205. Sleeves 212 are expanded by means of rods or slides 220 positioned therein, to form a head portion 225 in each root member 211 and 212.

In an alternate embodiment, not shown, brush segments according to the present invention could be mounted along the inside of a rotating hub, to brush items tumbled therein. From this it will be understood that a wide variety of support structures may be utilized in association with brush segments according to the present invention.

From the above, it will be understood that the mounting system according to the present invention provides for a unique versatility not previously readily obtainable. Custom designed brushes can be easily accomplished, through ready variation in segments. Segments can be easily dismounted and cleaned if necessary. Further, worn out segments can be readily replaced. Mounting does not, in general, require extreme precision. Further, mounting of brush segments can be effected in many instances without a dismounting of the hub from the finishing apparatus, FIG. 1.

It is to be understood that while certain embodiments to the present invention have been illustrated and described, the invention is not to be limited to specific forms, arrangement of parts, or methods herein described and shown.

What is claimed and desired to be secured by letters patent is as follows:

1. A cylinder brush finishing device comprising:

(a) a cylindrical hub having opposite ends and an outer surface; said hub including a plurality of substantially parallel, longitudinal, slots in communication with said hub outer surface; each of said slots extending between said hub opposite ends; said hub outer surface having a first radius of curvature;

(b) means mounting said hub for rotation about a longitudinal axis thereof;

(c) a drive mechanism for selectively rotating said cylindrical hub;

(d) a first arcuate substrate removably mounted on said hub and having first and second opposite surfaces and first and second side edges; said first arcuate substrate defining an arc between said first arcuate substrate side edges; said first arcuate substrate first surface being generally convex and said first arcuate substrate second surface being generally concave; said first arcuate substrate second surface having a radius of curvature smaller than said hub outer surface first radius of curvature, when said first substrate is not mounted in said finishing device;

(e) a carpet of bristles secured to said first substrate to extend outwardly from said first substrate first surface;

(f) at least one first substrate longitudinal root member projecting outwardly from said first arcuate substrate concave side and extending generally parallel to, and spaced from, said first substrate side edges; said first substrate root member being constructed and arranged for sliding engagement with a selected one of said cylindrical hub longitudinal slots by entering same at one of said hub end edges, to mount said first arcuate substrate to said cylindrical hub;

(g) means distorting said first substrate second, concave, surface toward a radius of curvature approximately equal to said hub outer surface radius of curvature, when said first substrate is mounted in said finishing device;

(h) a second arcuate substrate removably mounted on said hub and having first and second opposite surfaces and first and second side edges; said second arcuate substrate defining an arc between said second arcuate substrate side edges; said second arcuate substrate first surface being generally convex and said second arcuate substrate second surface being generally concave; said second arcuate substrate second surface having a radius of curvature smaller than said hub outer surface first radius of curvature, when said second substrate is not mounted in said finishing device;

(i) a caret of bristles secured to said second substrate to extend outwardly from said second substrate first surface;

(j) at least one second substrate longitudinal root member projecting outwardly from said second arcuate substrate concave side and extending generally parallel to, and spaced from, said second substrate side edges; said second substrate root member being constructed and arranged for sliding engagement with a selected one of said cylindrical hub longitudinal slots by entering same at one of said hub end edges, to mount said second substrate to said cylindrical hub;

(k) means distorting said second substrate second, concave, surface toward a radius of curvature approximately equal to said hub outer surface radius of curvature, when said second substrate is mounted in said finishing device;

(l) when said finishing device is operably assembled, said second substrate being oriented radially adjacent to said first substrate, with one of said first substrate side edges generally aligned parallel with and adjacent to one of said second substrate side edges; and, (m) means enabling said first and second substrates to be independently mounted on, and removed from, said cylindrical hub, while said hub is mounted in said finishing device.

2. A finishing device according to claim 1 wherein:

(a) said first substrate longitudinal root member is longitudinally continuous; and, (b) said second substrate longitudinal root member is longitudinally continuous.

3. A finishing device according to claim 1 wherein:

(a) said first substrate longitudinal root member is unitary with said first substrate; and, (b) said second substrate longitudinal root member is unitary with said second substrate.

4. A finishing device according to claim 1 including:

(a) a resin system mounting said carpet of bristles on said first substrate; and, (b) a resin system mounting said carpet of bristles on said second substrate.

5. A finishing device according to claim 1 including:

(a) a third arcuate substrate removably mounted on said hub and having first and second opposite surfaces and first and second side edges; said third arcuate substrate defining an arc between said third arcuate substrate side edges; said third arcuate substrate first surface being generally convex and said third substrate second surface being concave and having a radius of curvature smaller than said hub outer surface first radius of curvature, when said first substrate is not mounted in said finishing device;

(b) a carpet of bristles secured to said third substrate, to extend outwardly from said third substrate first surface;

(c) at least one third substrate longitudinal root member projecting outwardly from said third arcuate substrate concave side and extending generally parallel to, and spaced from, said third substrates side edges; said third substrate root member being constructed and arranged for sliding engagement with a selected one of said cylindrical hub longitudinal slots by entering same at one of said hub end edges, to mount said third arcuate substrate to said cylindrical hub;

(d) means distorting said third substrate second, concave, surface toward a radius of curvature approximately equal to said hub outer surface radius of curvature, when said third substrate is mounted in said finishing device; and, (e) when said finishing device is operably assembled, said third substrate being positioned longitudinally adjacent to said first substrate.

6. A finishing device according to claim 5 wherein:

(a) said first substrate carpet of bristles has a first distance of outward extension from said first substrate; and, (b) said third carpet of bristles has a second distance of outward extension from said third substrate; said first distance of outward extension being different from said second distance of outward extension.

7. A brush/hub combination comprising:

(a) a cylindrical hub having an end and an outer surface; said hub including a plurality of substantially parallel, longitudinal, slots in communication with said hub end and said hub outer surface;

(b) a first arcuate substrate removably mounted on said hub and having first and second opposite surfaces and first and second side edges; said first arcuate substrate defining an arc between said first arcuate substrate side edges; said first arcuate substrate first surface being generally convex and said first arcuate substrate second surface being generally concave; said first arcuate substrate second surface having a radius of curvature smaller than said hub outer surface first radius of curvature, when said first substrate is not mounted on said hub;

(c) a carpet of bristles secured to said first substrate to extend outwardly from said first substrate first surface;

(d) at least one first substrate longitudinal root member projecting outwardly from said first arcuate substrate concave side and extending generally parallel to, and spaced from, said first substrate side edges; said first substrate root member being constructed and arranged for sliding engagement with a selected one of said cylindrical hub longitudinal slots by entering same at said hub end edge, to mount said first arcuate substrate in said cylindrical hub;

(e) means distorting said first substrate second, concave, surface toward a radius of curvature approximately equal to said hub outer surface radius of curvature, when said first substrate is mounted on said hub;

(f) a second arcuate substrate removably mounted on said hub and having first and second opposite surfaces and first and second side edges; said second arcuate substrate defining an arc between said second arcuate substrate side edges; said second arcuate substrate first surface being generally convex and said second arcuate substrate second surface being generally concave; said second arcuate substrate second surface having a radius of curvature smaller than said hub outer surface first radius of curvature, when said second substrate is not mounted on said hub;

(g) a carpet of bristles secured to said second substrate to extend outwardly from said second substrate first surface;

(h) at least one second substrate longitudinal root member projecting outwardly from said second arcuate substrate concave side and extending generally parallel to, and spaced from, said second substrate side edges; said second substrate root member being constructed and arranged for sliding engagement with a selected one of said cylindrical hub longitudinal slots by entering same at one of said hub end edges, to mount said second substrate to said cylindrical hub;

(i) means distorting said second substrate second, concave, surface toward a radius of curvature approximately equal to said hub outer surface radius of curvature, when said second substrate is mounted on said hub; and, (j) when said brush/hub combination is operably assembled, said second substrate being oriented radially adjacent to said first substrate, with one of said first substrate side edges generally aligned parallel with and adjacent to one of said second substrate side edges.

* * * * *